US006289937B1

(12) United States Patent
Feer

(10) Patent No.: US 6,289,937 B1
(45) Date of Patent: Sep. 18, 2001

(54) SHED FORMING APPARATUS WITH RETURN SPRING DUST PREVENTION DEVICE

(75) Inventor: Mark Feer, Winterthur (CH)

(73) Assignee: AGM Jactex AG, Neuhausen am Rheinfall (CH)

( * ) Notice: Subject to any disclaimer, the term of this patent is extended or adjusted under 35 U.S.C. 154(b) by 0 days.

(21) Appl. No.: 09/580,835

(22) Filed: May 30, 2000

(30) Foreign Application Priority Data

May 30, 1999 (CH) ..... 1009/99

(51) Int. Cl.[7] ..... D03J 1/00
(52) U.S. Cl. ..... 139/1 C; 139/86; 15/301
(58) Field of Search ..... 15/301, 312.1; 139/1 C, 85, 86

(56) References Cited

U.S. PATENT DOCUMENTS 4,570,682 * 2/1986 Bachmann ..... 139/1 C
5,361,807 * 11/1994 Giovenzana ..... 139/1 C
5,608,961 * 3/1997 Piegeler ..... 29/452

* cited by examiner

*Primary Examiner*—Andy Falik
(74) *Attorney, Agent, or Firm*—Venable; Gabor J. Kelemen

(57) ABSTRACT

A shed-forming apparatus for a weaving machine includes warp thread guiding healds reciprocated vertically between an upper shed position and a lower shed position; a lowering frame; and return springs attached to each heald and to the lowering frame to reset the healds into the lower shed position. The lowering frame supports a channel through which an air stream is forced. The return springs are coupled to the channel for exposing the return springs to a pressure of an air flow to prevent dust deposition and lint formation on the return springs.

6 Claims, 2 Drawing Sheets

SHED FORMING APPARATUS WITH RETURN SPRING DUST PREVENTION DEVICE

CROSS REFERENCE TO RELATED APPLICATION

This application claims the priority of Swiss Application No. 1999 1009/99 filed May 30, 1999, which is incorporated herein by reference.

BACKGROUND OF THE INVENTION

This invention relates to a method for maintaining clean the return springs in a shed-forming apparatus in a weaving machine. The warp threads guided in healds between an upper shed position and a lower shed position are moved back and forth and at each heald a tension spring exerts a pulling force for resetting the healds into the lower shed position. The return springs are secured to a lowering floor or to lowering bars of a lowering frame.

Well-known shed-forming apparatuses are, among others, the so-called Jacquard machines where two hooks are connected to one another by a common block-and-tackle. The hooks may be coupled, for example, by magnetic means, to two continuously oppositely moved bars, whereby the heald suspended on the block-and-tackle executes, together with the warp thread, a controlled vertical motion between an upper shed position and a lower shed position. Each heald is connected to a tension spring which resets the heald into the lower shed position. The tension springs are secured to the lowering floor or to the lowering bars of a lowering frame.

A significant problem involved in machines of the above-outlined type is a dust deposition and lint formation on the return springs which rapidly leads to operational disturbances and requires long down periods of the machine for performing maintenance work.

SUMMARY OF THE INVENTION

It is an object of the invention to provide a method and a device which ensure a cleaning of the tension springs and effectively prevent dust deposition or lint formation thereon, whereby down periods caused by malfunctioning are practically eliminated.

This object and others to become apparent as the specification progresses, are accomplished by the invention, according to which, briefly stated, the shed-forming apparatus for a weaving machine includes warp thread guiding healds reciprocated vertically between an upper shed position and a lower shed position; a lowering frame; and return springs attached to each heald and to the lowering frame to reset the healds into the lower shed position. The lowering frame supports a channel through which an air stream is forced. The return springs are coupled to the channel for exposing the return springs to a pressure of an air flow to prevent dust deposition and lint formation on the return springs.

According to a preferred embodiment for performing the method of the invention, the tension springs may be directly or indirectly coupled at the lowering frame to a pneumatic channel communicating with a source of pressurized air.

Further, the pressurized medium flowing through the channel may have a uniform pressure level or it may be regulated, particularly to compensate for air leakages.

In the shed-forming apparatus which incorporates the invention, the warp threads, guided in healds, are movable back and forth between an upper shed position and a lower shed position. For returning the healds into the lower shed position, to each heald a tension spring is connected which is secured to a lowering floor or to the lowering bars of a lowering frame.

Thus, according to the invention, the shed-forming apparatus has a channel, situated on the lowering frame, for guiding pressurized air therein. The tension springs are directly or indirectly exposed to the air flow, whereby dust deposition and lint formation on the tension springs are prevented.

Preferably, the pressurized air channel may be bordered on the lowering frame on the top by the lowering floor with the intermediary of sealing and spring means.

According to a further advantageous feature, the channel bottom is height-adjustable to vary the flow passage cross section of the channel and to thus alter the pressure of the air flow. Further, the tension springs may be directly or indirectly connected in a flow-tight manner with the lowering floor as part of the pressurized air channel or the tension springs may be indirectly coupled to the channel by means of tubular intermediate pieces secured to the lowering floor.

DESCRIPTION OF THE PREFERRED EMBODIMENTS

Figure 1:
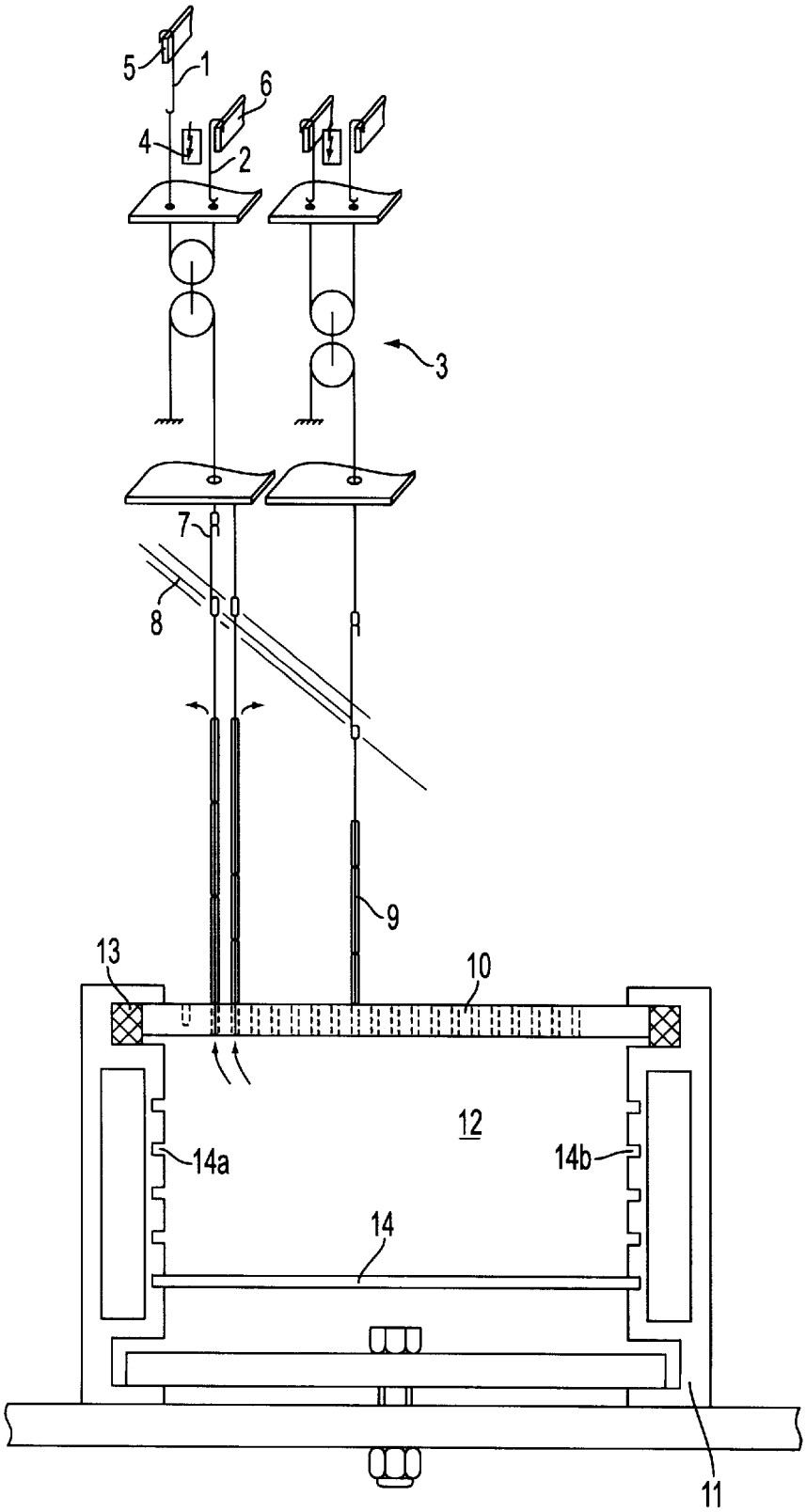
FIG. 1 is a schematic front elevational view (partially in perspective view) of a preferred embodiment of the invention.

Turning to FIG. 1, the shed-forming apparatus for weaving machines may be an open-shed Jacquard machine in which two hooks 1 and 2 are connected at their lower end by a common block-and-tackle 3. The hooks 1 and 2, dependent on their control, such as a magnet assembly 4, may be coupled to two continuously oppositely running bars 5 and 6. By virtue of this arrangement, the heald 7 suspended on the block-and-tackle 3 and thus the respective warp thread 8 are imparted a controlled vertical motion between an upper shed position shown at the left in FIG. 1 and a lower shed position shown at the right in FIG. 1.

Shed-forming apparatuses of the above-outlined type are generally known; a substantial number of other systems are feasible to reciprocate the healds with the warp threads for forming the shed.

It is a common characteristic of the above-outlined known shed-forming apparatuses that, for resetting the healds into the lower shed position, each heald is imparted a pulling force of a respective tension spring 9 secured to the heald at one end and to the lowering floor 10 or the lowering bars of a lowering frame 11 at the other end.

The mechanical resetting device is exposed to substantial wear and a high probability of operational disturbances because of dust deposition and lint formation on the return springs 9. Therefore, according to the invention, within the return springs (coil springs) 9 an air flow is produced which effectively prevents any dust deposition or lint formation on the return springs. For this purpose, the return springs 9 are directly or indirectly coupled to a channel 12 through which pressurized air flows and which is arranged on the lowering frame 11.

Figure 2:
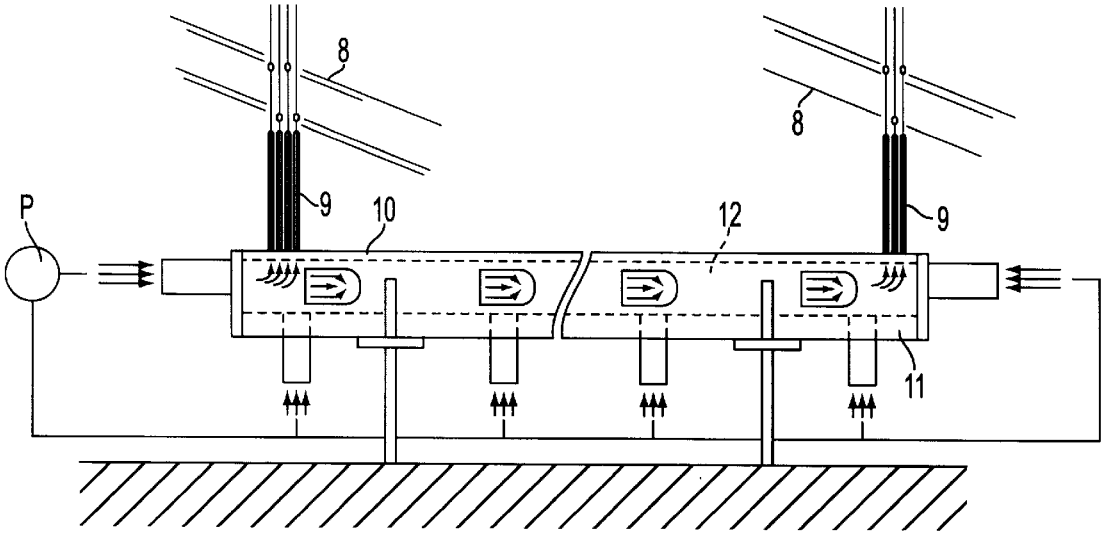
FIG. 2 is a fragmentary side elevational view, on an enlarged scale, of a part of the structure shown in FIG. 1.

FIG. 2 illustrates the manner in which the pressurized air may be introduced into the channel 12 from a pressure source P. Further, the pressure medium may be supplied at the same pressure level and/or, for compensating for flow leakages, a correcting regulation (not illustrated) may be provided. Further, the pressure medium may be supplied continuously or intermittently.

As shown in FIGS. 1 and 2, the channel 12 is bordered on the top by the lowering bottom 10 which is supported by sealing and spring means 13 on the lowering frame 11. Further, a height-adjustable channel bottom 14 is provided to change the flow passage cross section of the channel 12 to thus effect a pressure change therein. The height adjustment is effected by inserting the channel bottom 14 into a selected pair of aligned grooves, such as grooves 14*a* and 14*b*.

To ensure that for preventing dust deposition and lint formation on the tension springs 9, an air stream pressure is generated thereon, the tension springs 9 are directly or indirectly connected with the lowering bottom 10 to form a continuation of the pressurized air channel 12 and are thus exposed to the air flow.

Figure 3:
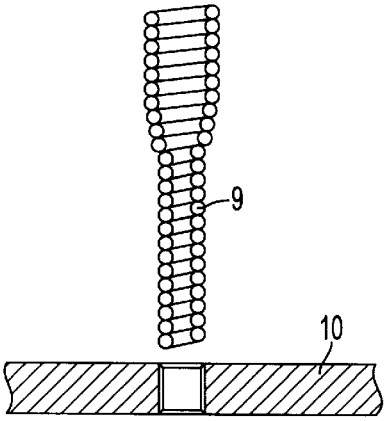
FIGS. 3, 4 and 5 are schematic sectional side elevational views of three variants showing connections of the return springs with the lowering floor of the shed-forming apparatus.
Figure 4:
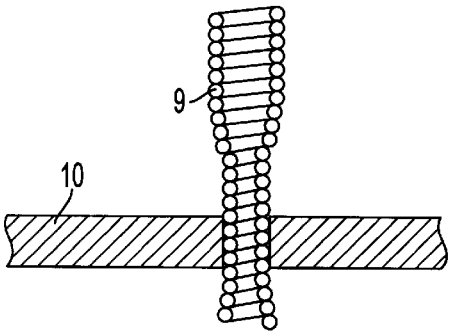
Figure 5:
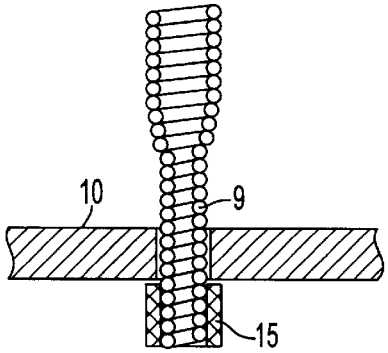

FIGS. 3, 4 and 5 show various direct connections of tension springs 9 with the lowering bottom 10 by a thread-in connection (FIG. 3), by expanding (FIG. 4) or by the use of a counter nut 15 (FIG. 5).

Figure 6:
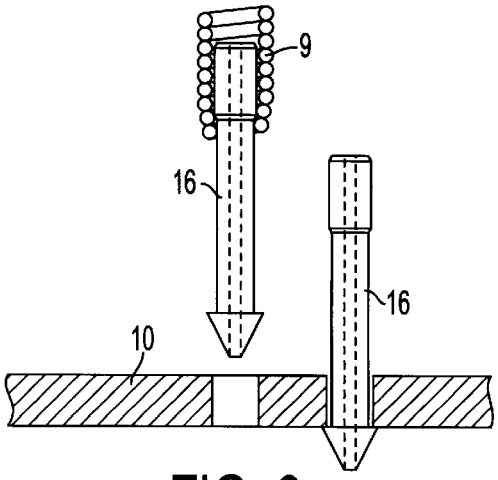
FIG. 6 is a fragmentary sectional side elevational view, on an enlarged scale, illustrating a connection of the return springs indirectly by means of tubular components secured to the lowering bottom.

According to FIG. 6, the tension springs 9 may be indirectly connected (by a threaded connection or by an adhesive) to the lowering bottom 10 by means of tubular intermediate pieces 16 secured to the bottom 10.

The described heald return mechanism associated with a shed-forming apparatus is practically free from wear or other harmful effects and permits retrofitting without difficulties.

It will be understood that the above description of the present invention is susceptible to various modifications, changes and adaptations, and the same are intended to be comprehended within the meaning and range of equivalents of the appended claims.

What is claimed is:

1. In a shed-forming apparatus for a weaving machine, including warp thread guiding healds reciprocated vertically between an upper shed position and a lower shed position;

a lowering frame; and return springs attached to each heald and to the lowering frame to reset the healds into the lower shed position;

the improvement comprising (a) a channel supported by the lowering frame;

(b) means for forcing an air stream through said channel; and (c) means for coupling said return springs to said channel for exposing said return springs to a pressure of the air stream to prevent dust deposition and lint formation on said return springs.

2. The shed-forming apparatus as defined in claim 1, further comprising a lowering floor supported on said lowering frame; said lowering frame forming an upper boundary of said channel.

3. The shed-forming apparatus as defined in claim 1, further wherein said channel has a bottom; further comprising height-adjusting means for changing a height position of said bottom for varying a flow passage cross section of said channel.

4. The shed-forming apparatus as defined in claim 1, wherein said return springs are supported on said lowering floor and an inside of said return springs is in pneumatic communication with said channel.

5. The shed-forming apparatus as defined in claim 4, wherein said return springs are supported in an air tight member by said lowering floor and form part of said channel.

6. The shed-forming apparatus as defined in claim 5, further comprising sleeves having one end secured to said lowering floor and an opposite end supporting respective said return springs to attach said return springs indirectly to said lowering floor.

* * * * *